United States Patent [19]

Iwata et al.

[11] Patent Number: 4,953,844

[45] Date of Patent: Sep. 4, 1990

[54] PAPER SUPPLY DEVICE WITH A FUNCTION OF AUTOMATICALLY SENSING THE LIFE OF FEED ROLLERS

[75] Inventors: Yasuhiro Iwata; Yuzi Uchigasaki, both of Yokohama, Japan

[73] Assignee: Kabushiki Kaisha Toshiba, Kawasaki, Japan

[21] Appl. No.: 314,036

[22] Filed: Feb. 23, 1989

[30] Foreign Application Priority Data

Mar. 2, 1988 [JP] Japan ..... 63-47403

[51] Int. Cl.[5] ..... B65H 5/06

[52] U.S. Cl. ..... 271/9; 271/111

[58] Field of Search ..... 271/9, 111, 110

[56] References Cited

U.S. PATENT DOCUMENTS 4,108,427 8/1978 Komori ..... 271/111 X 4,775,139 10/1988 Honjo ..... 271/111 X

*Primary Examiner*—Richard A. Schacher

*Attorney, Agent, or Firm*—Foley & Lardner, Schwartz, Jeffery, Schwaab, Mack, Blumenthal & Evans

[57] ABSTRACT

A paper supply device includes a plurality of feeders for feeding sheets of paper respectively. An actuator actuates one of the feeders which is used for feeding the paper. A detector respectively detects the frequency of the use of the feeders actuated by the actuator. An indicator indicates the result of the detection for the respective feeders according to the frequency of the use of the feeder detected by the detector.

16 Claims, 10 Drawing Sheets

| | |
|---|---|
| MANUAL FEED ROLLER | 1508 |
| UPPER PICKUP ROLLER | 8944 |
| LOWER PICKUP ROLLER<br>LOWER FEED ROLLER<br>LOWER SEPARATING ROLLER | 6230 |
| UPPER FEED ROLLER<br>UPPER SEPARATING ROLLER | 10452 |
| REGIST ROLLERS | 16682 |

40

FIG. 10

PAPER SUPPLY DEVICE WITH A FUNCTION OF AUTOMATICALLY SENSING THE LIFE OF FEED ROLLERS

BACKGROUND OF THE INVENTION

1. Field of the Invention

The present invention relates to a device for supplying an image-forming medium such as paper or film and, more particularly, to a supply device for counting the number of supplied image-forming mediums to sense the life of feed rollers.

2. Description of the Related Art

A paper supply device is used in an image forming apparatus, such as a copying machine or a printer, so as to feed paper or film serving as an image forming medium to an image-forming section. Prior to the formation of an image, sheets of paper, for example, are stored in a paper feeding section. In forming the image the sheets of paper are taken out from the paper feeder one by one by means of frictional force between the paper and feed rollers and then fed to the image-forming section via some feed rollers. The friction with the feed rollers is indispensable to paper feed. Thus several tens of thousands of paper feeds will degrade surface characteristics of the feed rollers, lowering the feeding capability. It is thus necessary to sense the degradation of the feed rollers so as to replace feed rollers regularly. In a conventional copying machine, to sense the degradation or life of the feed rollers, the frequency of use of a developing unit used for copying is counted. With this method, however, it is difficult to determine the frequency of use of the feed rollers for feeding paper. Hence the time of replacement of the feed rollers is left to servicemen to decide. For this reason a device is desired which can accurately determine the frequency of use of the feed rollers to sense their degradation automatically.

SUMMARY OF THE INVENTION

It is accordingly an object of the present invention to provide a paper supply device which can accurately determine the frequency of use of feed rollers to sense their degradation or life automatically.

According to the present invention there is provided a paper supply device comprising a plurality of feeding means for feeding sheets of paper respectively, means for actuating one of the feeding means which is used for feeding the paper, means for respectively detecting the frequency of the use of the feeding means actuated by the actuating means, and means for indicating the result of the detection for the respective feeding means according to the frequency of the use of the feeding means detected by the detecting means.

BRIEF DESCRIPTION OF THE DRAWINGS

The foregoing aspects and other features of the invention will be explained in the following description in connection with the accompanying drawings wherein:

FIG. 10 shows a liquid crystal panel for displaying the number of sheets fed by each feed roller.

DETAILED DESCRIPTION OF THE PREFERRED EMBODIMENTS

Figure 1:
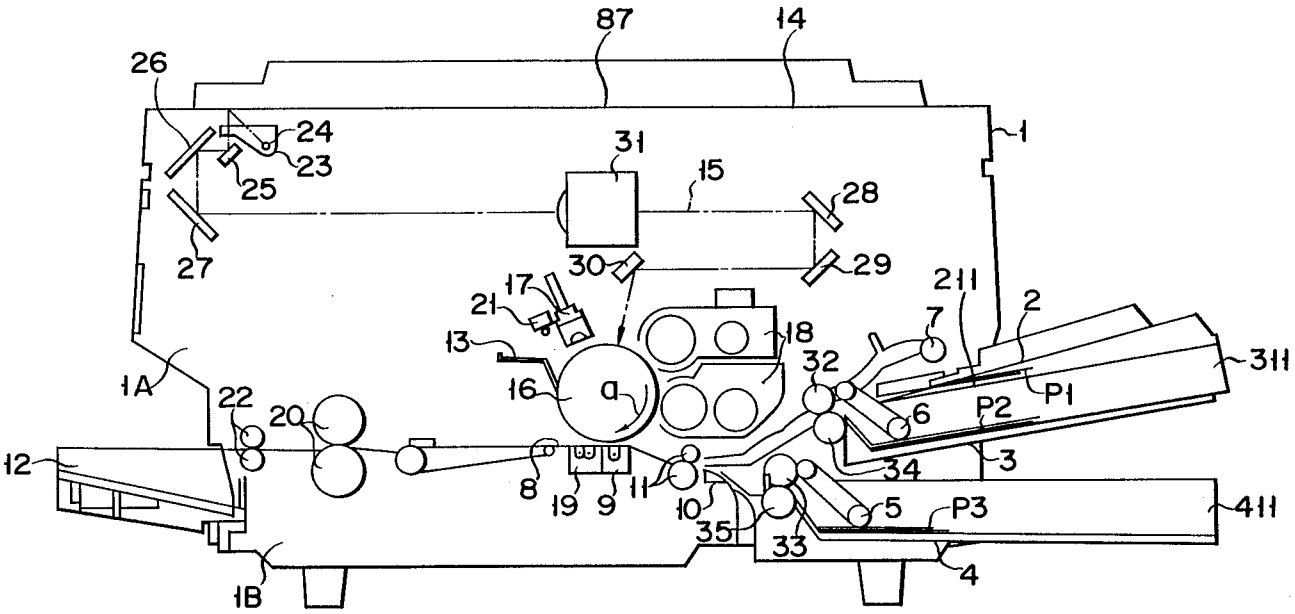
FIG. 1 is a schematic sectional view of a copying machine to which a paper supply device of the invention is applied.

Referring now to FIG. 1, a copier using a paper feeder device as a pape supply device embodying the present invention includes a document glass plate 14 provided on the top of a body 1 of the copier (simply referred to as body 1 hereinafter) and an operating panel 87 provided next to the document plate. At the right-hand side of body 1 there are provided an upper cassette feeder 3 and a lower cassette feeder 4 which serve as a paper storing section. An upper cassette 311 and a lower cassette 411 are loaded into cassette feeders 3 and 4, respectively. The cassette cover of upper cassette 311 serves as a manual paper feeder 2 adapted to feed copying paper Pl by hand if need arises. At the left-hand side of body 1 there is provided a copied paper outlet tray 12. A photosensitive drum 16 is disposed substantially at the center of body 1. Disposed around photosensitive drum 16 are a charger 17, an optical system 15, a developing unit 18, a transfer charger 9, a charger 19 for separation, a cleaner 13 and a charge removal lamp 21.

A copying paper feed path 8 is arranged at the underside of body 1. Feed path 8 guides transfer paper P2 automatically taken out from upper paper feed cassette 311 by a pickup roller 6, transfer paper P3 automatically taken out from lower paper feed cassette 411 by a pickup roller 5 and transfer paper Pl manually fed from hand-feed plate 211 to outlet tray 12 through a gap between photosensitive drum 16 and transfer charger 9. A paper stop switch 10, regist rollers 11, heat rollers 20 and outlet rollers 22 are disposed in this order along copying paper feed path 8. The paper supply device according to the present invention includes each pape feeder through regist rollers 11 and will be detailed later.

Optical system 15 comprises an exposure lamp 24 having its back covered with a reflector 23, mirrors 25 through 30 and a lens 31.

Photosensitive drum 16 is driven in the direction of an arrow a by a driving mechanism (not shown) in synchronism with optical system 15. At the time of copying, photosensitive drum 16 is uniformly charged by charger 17. Subsequently a document is uniformly illuminated by exposure lamp 24 and a document image is projected onto photosensitive drum 16 by optical system 15 so that an electrostatic latent image is formed on the drum. The electrostatic latent image is processed by developing unit 18 to a toner image and then sent to transfer charger 9.

Prior to copying, on the other hand, transfer paper P1, P2 or P3 (simply referred to as transfer paper P hereinafter), which is fed automatically or manually, is fed to transfer charger 9 by regist rollers 11. Regist rollers 11 are synchronized with photosensitive drum 16 by turning paper stop switch 10 on. The toner image is subsequently transferred to transfer paper P by transfer charger 9. Transfer paper P to which the toner image has been transferred is then separated from photosensitive drum 16 by separating charger 19 and guided to heat rollers 20 via transfer paper feed path 8. The transferred image is fused by the heat rollers and the transferred paper is then discharged to outlet tray 12 by outlet rollers 22.

After the toner image is transferred on transfer paper P the residual toner on photosensitive drum 16 is cleaned by cleaner 13. Afterward the residual image on photosensitive drum 16 is erased by charge removing lamp 21 to make ready for next copying operation.

In body 1, an upper frame and a lower frame, which are not shown, are provided which have their ends pivoted and their other ends expanded to make an angle of about 30 degrees therebetween. Charger 17, optical system 15, exposure lamp 24, developing unit 18, cleaner 13 and charge removing lamp 21 are mounted to the upper frame by proper means to surround photosensitive drum 16. Moreover, to the upper frame are mounted document plate 14, the upper automatic paper feeder constituted by pickup roller 6, feed roller 32 and separating roller 34 and the manual paper feeder constituted by feed roller 7, thereby constituting a upper unit lA. On the other hand, to the lower frame are mounted upper cassette 311, lower cassette 411, transfer charger 9, separating charger 19, heat rollers 20, discharging rollers 22 and paper outlet tray 12 by proper means, thereby constituting a lower unit 1B.

Figure 3:
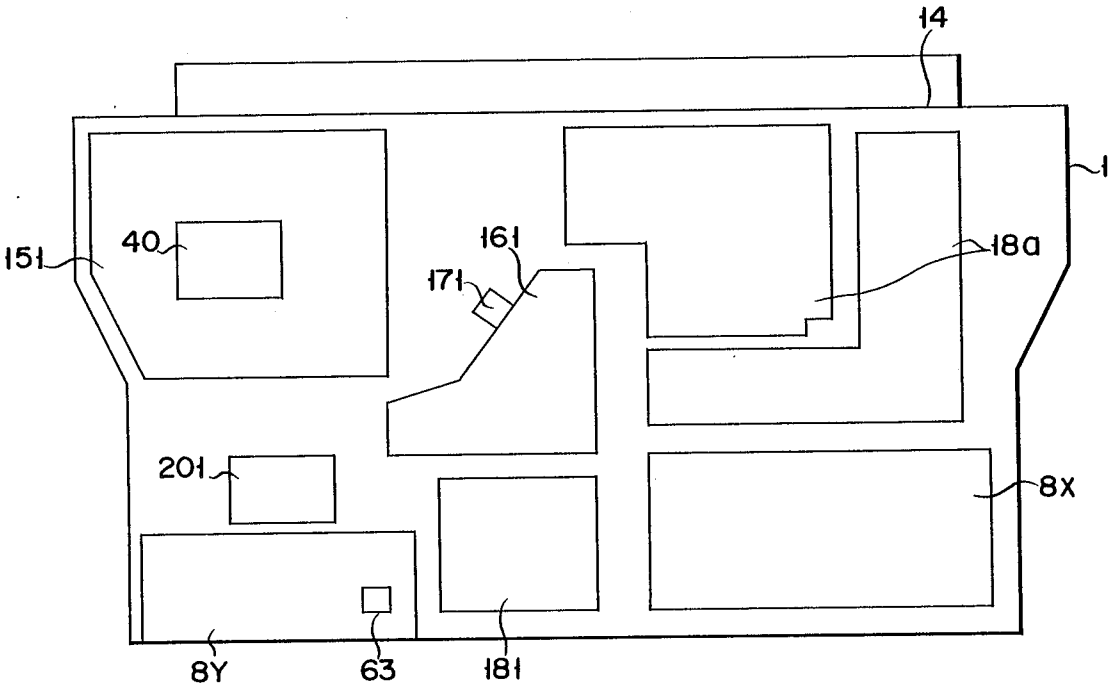
FIG. 3 is a front plan view of the copying machine of FIG. 1 with its front cover omitted

FIG. 3 shows the disposition of the above units with the front cover of body 1 removed. In this Figure there are shown color and black developing units 18*a*, transfer paper feed path covers 8*x*, 8*y*, a residual toner scrapping cartridge 181, a photosensitive drum cover 161, charger 171, a fixing unit cover 201, an optical system cover 151, a display switch 63, a liquid crystal display panel 40 serving as a first display unit and document plate 14.

When the front cover is opened, display switch 63 is turned on so that the number of sheets fed by each feed roller is displayed on liquid crystal display panel 40 (see FIG. 10). After the front cover is opened, body 1 can be opened along transfer paper feed path 8 by an opening and shutting device not shown.

The opening of body 1 along transfer paper feed path 8 permits easy replacement of the feed rollers in the path. Particularly since the number of sheets of paper fed by each feed roller is displayed on liquid crystal display panel 40, it is possible to determine which of the rollers should be replaced.

Figure 4:
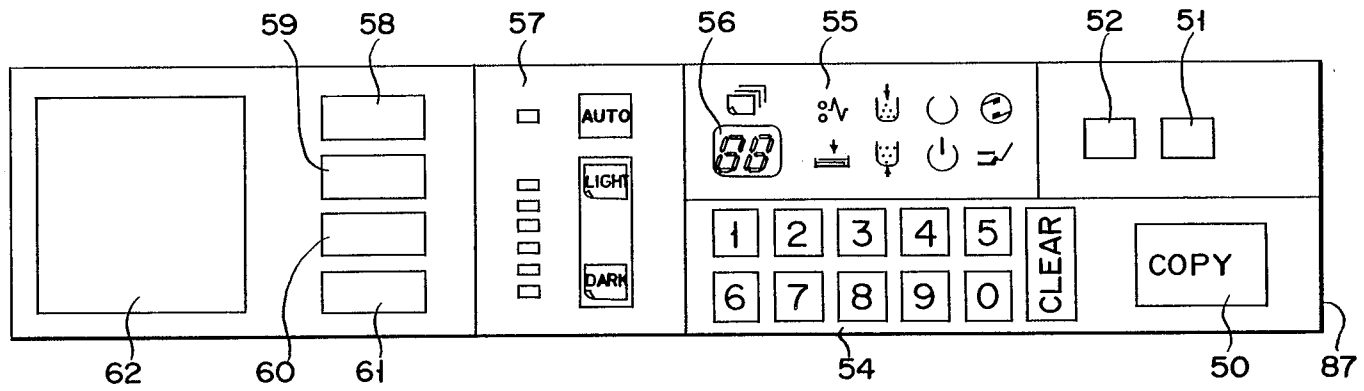
FIG. 4 is a top plan view of an operating panel of the copying machine of FIG. 1.

FIG. 4 shows operating panel 87, which is provided with, in the upper right-hand section thereof, an interrupt key 51 for setting an interrupt mode for interrupt copying and a preheat key 52 for preheating body 1. Adjacent to preheat key 52 are provided a lamp section 55 for displaying the operating conditions of body 1 by the use of lamps and a display section 56 for displaying the set number of sheets of paper to be copied. Reference numeral 50 denotes a copy key for carrying out copying, and reference numeral 54 denotes ten keys for setting the number of sheets of paper to be copied. Reference numeral 57 denotes a density setting section for setting the copy density. To the left of density setting section 57 are provided a color select key 58 for selecting a color for copy, a cassette select key 59 for selecting a paper feed cassette, an enlargement/reduction key 60 for setting an enlargement mode or a reduction mode and a key 61 for setting a unity magnification mode. At the leftmost section of the operating panel 87 a liquid crystal display section 62 is provided which serves as a second display unit for displaying operating conditions of the copier.

Figure 6:
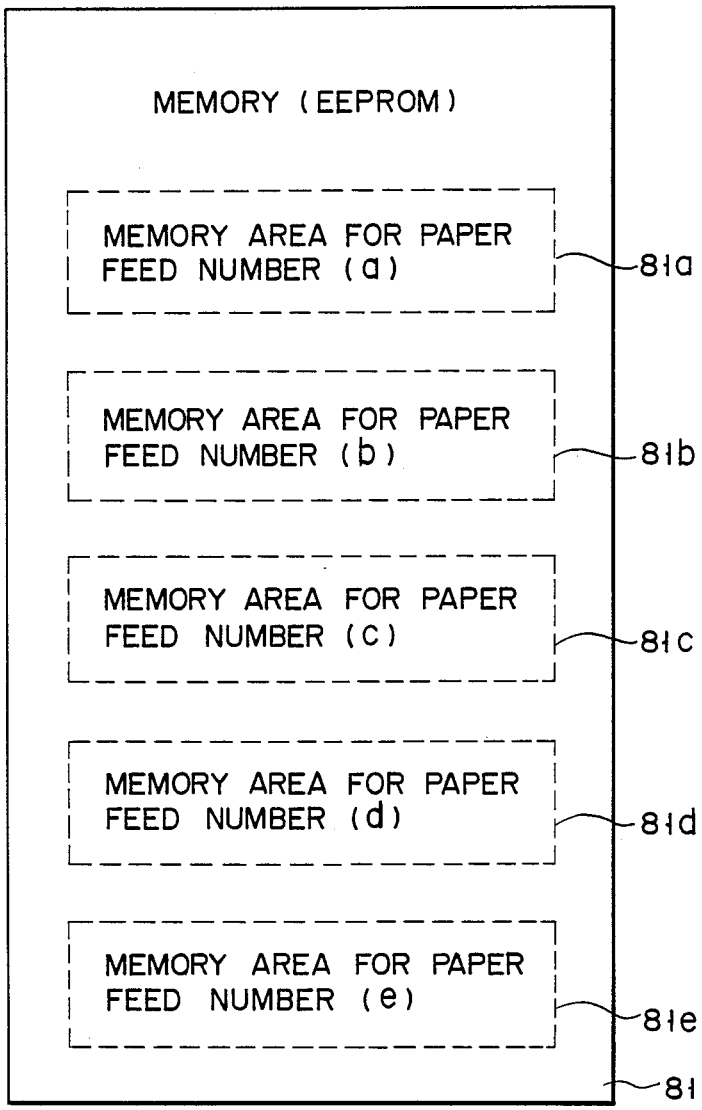
FIG. 6 shows an arrangement of a memory device used in the copying machine of FIG. 1.

When a paper feed cassette is selected by cassette select key 59, a memory area corresponding to the selected cassette is set in a memory device (see FIG. 6). In the case of manual feed from manual paper feeder 2, however, the corresponding memory area is set by a manual feed switch which is turned on when transfer paper P1 is loaded, not by a key.

Next, as an example of the paper supply device of the present invention, the paper feed device will be described in detail with reference to FIG. 5.

Figure 5:
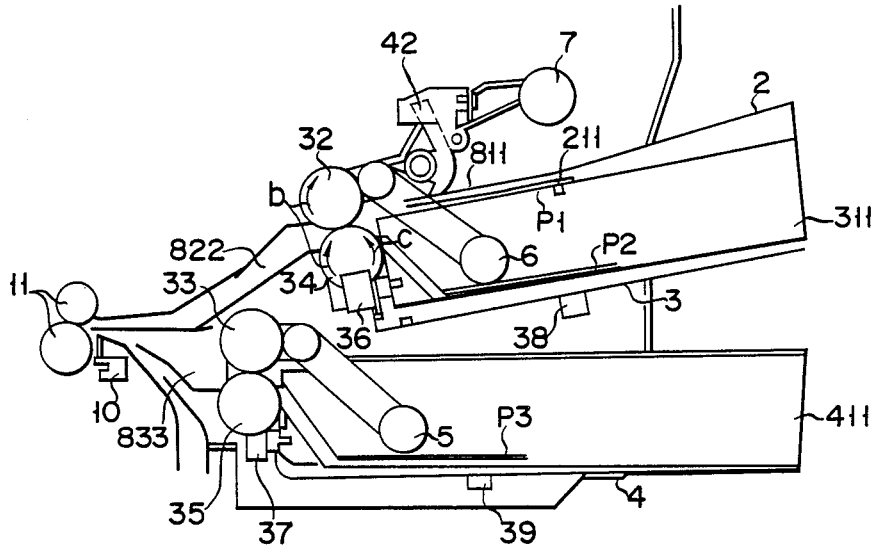
FIG. 5 is a schematic sectional view of the paper supply device of the present invention shown in FIG. 1.

As shown in FIG. 5, to the right-hand side of the paper feed apparatus are provided three paper feeder sections: manual paper feeder 2, upper cassette feeder 3 and lower cassette feeder 4. Paper feeders 2, 3 and 4 contain transfer paper Pl, P2 and P3 of proper sizes. Furthermore, upper cassette 311 and lower cassette 411 are of a removably-mounted cartridge type. This will promote efficiency in changing the size of transfer paper and replenishing the cassette with transfer paper P2 or P3. Transfer paper feed paths for guiding transfer paper P1, P2 and P3 to regist rollers 11 are formed separately. That is, feed path 811 for transfer paper P1 extends from manual feed roller 7 to feed roller 32 and separating roller 34. Manual feed switch 42 is placed in an intermediate position of feed path 811. Feed path 822 for transfer paper P2 extends from pickup roller 6 to regist rollers 11. Feed roller 32, separating roller 34 and paper stop switch 10 are placed in sequence down feed path 822. Further, feed path 833 for transfer paper P3 extends from pickup roller 5 to regist rollers 11. Feed roller 33, separating roller 35 and paper stop switch 10 are disposed in sequence down feed path 833. Feed path 811 joins feed path 822 at feed roller 32 and separating roller 34.

In feed path 822, transfer paper P2 is taken out by pickup roller 6 which is lowered and rotated by a driving mechanism not shown and guided to a portion of contact between feed roller 32 and separating roller 34. At this time feed roller 32 rotates in the direction of an arrow designated at b as shown. Likewise separating roller 34 is driven to rotate in the direction of b as shown. In the absence of transfer paper 2 or in the case of one-sheet feed, friction will thus occur between feed roller 32 and separating roller 34 or between transfer paper P2 and separating roller 34. At this time a spring joint provided around an axle (not shown) slips, causing separating roller 34 to rotate in the direction of an arrow designated at c as shown. Namely, in the case of one-sheet feed, transfer paper P2 can be fed to paper stop switch 10. In case where two sheets of transfer paper P2 is fed simultaneously, since friction between the sheets of transfer paper P2 is small, both of separating roller 34 and feed roller 32 rotate in the direction of b. That is, in the case of two-sheet feed the upper sheet is fed to paper stop switch 10 by means of feed roller 32, while the lower sheet is returned to cassette 311 by means of separating roller 34. Thus, only one sheet of transfer paper P2 can be fed. Paper stop switch 10 is turned on after the lapse of a predetermined time from the feed of transfer paper P2 by feed roller 32 and thus transfer paper P2 is aligned with regist rollers 11 so that it ma be fed to the section for transfer process.

The same is true of feed path 833 for transfer paper P3.

When transfer paper P1 is loaded into manual paper feeder 2, manual feed switch 42 is turned from off to on, thereby sensing the feed of paper. Further, manual roller 7 is lowered and then rotated by a driving mechanism (not shown) to feed transfer paper P1 to the contact portion between feed roller 32 and separating roller 34. Feed path 822 then follows so that transfer paper P1 is fed in the same way as transfer paper P2 described above.

The following relationships will be found with the paper feeders and the rollers disposed in the feed paths.

The number of sheets fed by manual feed roller 7 is equal to the number of sheets fed from manual paper feeder 2. The number of sheets fed by pickup roller 6 is equal to the number of sheets fed from upper cassette feeder 3. The number of sheets fed by feed roller 32 and separating roller 34 is equal to the sum of sheets fed from manual paper feeder 2 and upper cassette feeder 3. The number of sheets fed by pickup roller 5, feed roller 33 and separating roller 35 is equal to the number of sheets fed from lower cassette feeder 4. The number of sheets fed by regist rollers 11 is equal to the sum of sheets from paper feeders 2, 3 and 4.

Various rollers described above utilize a surface material with frictional force, such as rubber, in order to feed transfer paper P. For this reason the replacement of the rollers is needed in accordance with the life of the material. The life of the friction material means the margin of abrasion for use. This will be judged by the number of sheets fed from each paper feeder.

In FIG. 5, an upper size switch 36 and a lower size switch 37 are disposed at the rear of upper cassette feeder 3 and lower cassette feeder 4, respectively. Paper empty switches 38 and 39 are disposed at the bottom of upper cassette feeder 3 and lower cassette feeder 4, respectively. Each of upper and lower size switches 36 and 37 serves as cassette unloading signal generating means which detects loading or unloading of a corresponding cassette to generate a signal indicative of unloading of the cassette when it is unloaded. When upper cassette 311 is unloaded, upper size switch 36 is closed so that a cassette unloading signal is applied to the control circuit (see FIG. 2). When lower cassette 411 is unloaded, lower size switch 37 operates in the same manner as switch 36. In this state the lamp for paper replenishment in lamp section 55 (see FIG. 4) blinks so that the depression of copy key 50 is not allowed.

Figure 2:
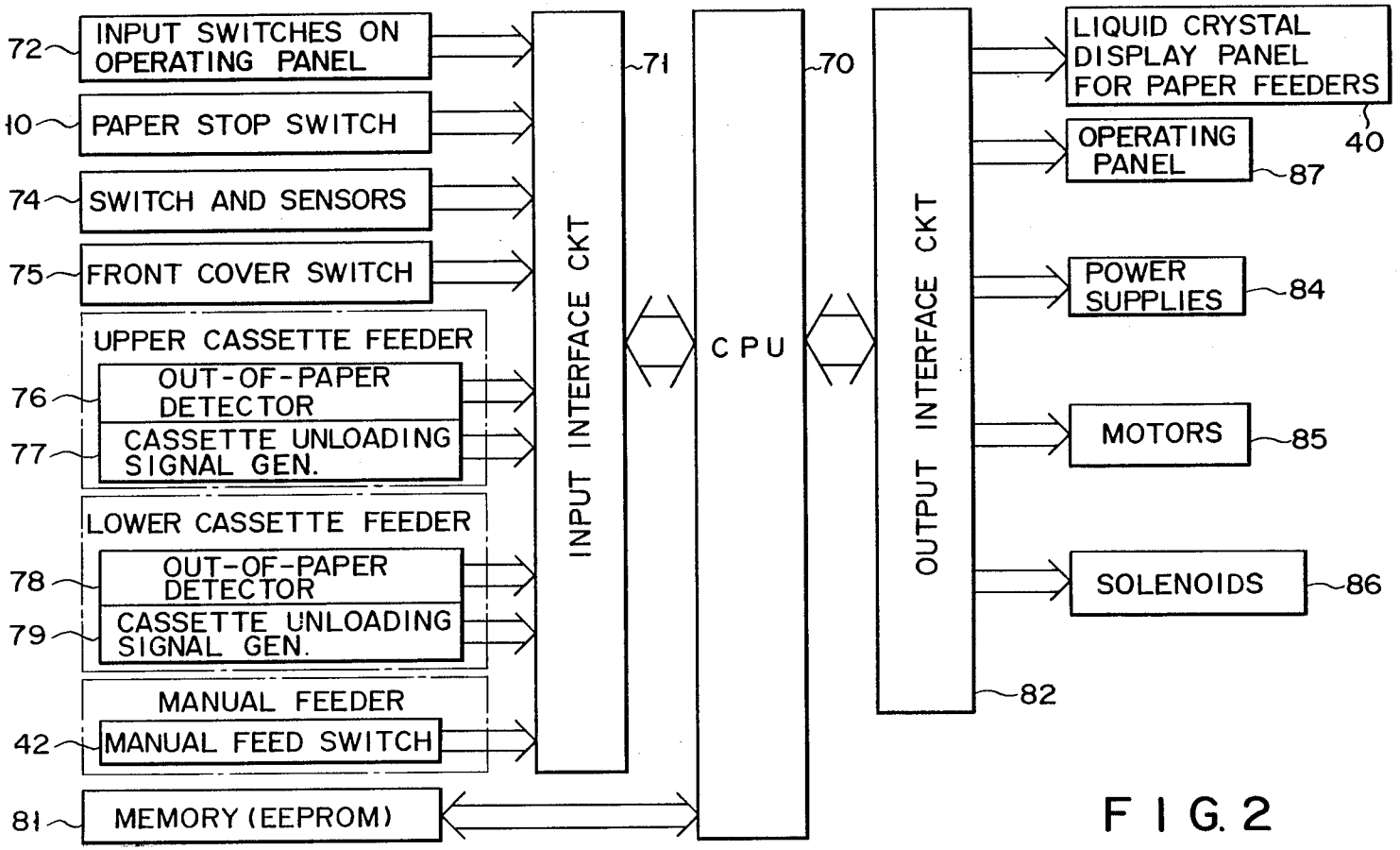
FIG. 2 shows a control circuit used in the copying device of FIG. 1.

Each of paper empty switches 38 and 39 serves as empty cassette detector which detects the presence or absence of transfer paper P in a corresponding cassette to produce a signal. When at least one of the cassettes is out of transfer paper P, an out-of-paper signal is applied to the control circuit (FIG. 2). In this state the display lamp for paper replenishment in lamp section 55 blinks as described above, allowing no depression of copy key 50.

A manual feed switch 42 is disposed at the rear of manual paper feeder 2 for transfer paper P1. This switch serves as transfer paper insertion detecting means which detects insertion or noninsertion of transfer paper P1 to produce a signal. When a sheet of transfer paper P1 is inserted into manual paper feeder 2, manual feed switch 42 is closed so that a paper insertion signal is applied to the control circuit. In this state liquid crystal display unit 62 (FIG. 4) displays the setting of the manual paper feeder and the depression of cassette select key 59 is not allowed.

FIG. 2 shows the control circuit for the paper supply device of the present embodiment. That is, CPU 70 serves as a main controller for controlling the copier. Connected to CPU 70 via an input interface circuit 71 are the following units: paper stop switch 10, input switches 72 comprised of various keys on operating panel 87, front cover switch 75, some other switches and sensors 74 needed for copying operation, manual feed switch 42 for detecting insertion of transfer paper P1 into manual paper feeder 2, out-of-paper detector 76 and cassette unloading signal generator 77 for upper cassette feeder 3, and out-of-paper detector 78 and cassette unloading signal generator 779 for lower cassette feeder 4. Connected to CPU 70 via an output interface circuit 82 are the following units: liquid crystal display panel 40 for the paper feeders, operating panel 87 including lamp section 55 and liquid crystal display unit 62, power supplies 84 for manual feeder 2, upper cassette feeder 3 and lower cassette feeder 4, motors 85 and solenoids 86.

Cassette unloading signal generators 77 and 79 include upper size switch 36 and lower size switch 37 described above, respectively. Identification information generators (not shown) are also provided which produce identification codes (indicating the sizes of the contained transfer paper) inherent in the cassettes. The identification codes are entered into CPU 70 via input interface 71 and then supplied to control panel 87 via output interface 82, allowing the visual identification of the size of the transfer paper.

An output signal of paper stop switch 10 also is supplied to CPU 70 via input interface circuit 71. The output signal is adapted to establish synchronization between the rotation of photosensitive drum 16 and the feed of transfer paper P to transport transfer paper P from regist rollers 11. The output signal is counted by a counting program in CPU 70. The count value for the signal is then stored in memory 81 (FIG. 6).

Memory 81 is formed of an electrically erasable programmable read-only memory (EEPROM) adapted to store the number of feeds of paper (the number of paper feeding operations) calculated by CPU 70. The memory will be detailed hereinafter.

According to the embodiment, memory 81 comprises memory areas corresponding to the respective feed rollers as shown in FIG. 6. Each of the memory areas stores the number of sheets of paper fed by a corresponding feed roller. The count value is formed of, for example, 4 bits and stored in each of the memory areas corresponding to the respective feed rollers in a BCD (binary-coded decimal) code.

As described above, the number of sheets of paper fed by each feed roller is equal to the number of sheets of paper from the corresponding paper feeder or the sum of feeds of paper from paper feeders and will be expressed as follows:

the number of sheets of paper fed by manual feed roller 7=the number (a) of sheets fed from manual feeder 2;

the number of sheets of paper fed by pickup roller 6=the number (b) of sheets fed from upper cassette feeder 3;

the number of sheets of paper fed by each of pickup roller 5, feed roller 33 and separating roller 35=the number (c) of sheets fed from lower cassette feeder 4;

the number of sheets of paper fed by feed roller 32 and separating roller 34=the sum (d) of sheets fed from manual feeder 2 and upper cassette feeder 3; and the number of sheets of paper fed by regist rollers 11=the sum (e) of sheets fed from manual feeder 2, upper cassette feeder 3 and lower cassette feeder 4.

To store these values (a), (b), (c), (d) and (e), five memory areas are set in memory 81, the areas being designated at 81(*a*), 81(*b*), 81(*c*), 81(*d*) and 81(*e*), respectively, as shown in FIG. 6. In the case of feed of paper from manual feeder 2, the number of feeds of paper is stored in memory areas 81(*a*), 81(*d*) and 81(*e*). In the case of feed of paper from upper cassette feeder 3, the number of feeds of paper is stored in memory areas 81(*b*), 81(*d*) and 81(*e*). In the case of feed of paper from lower cassette feeder 4, the number of feeds of paper is stored in memory areas 81(*c*) and 81(*e*). In this way, the frequency of use of each paper feeder is detected.

Figure 7:
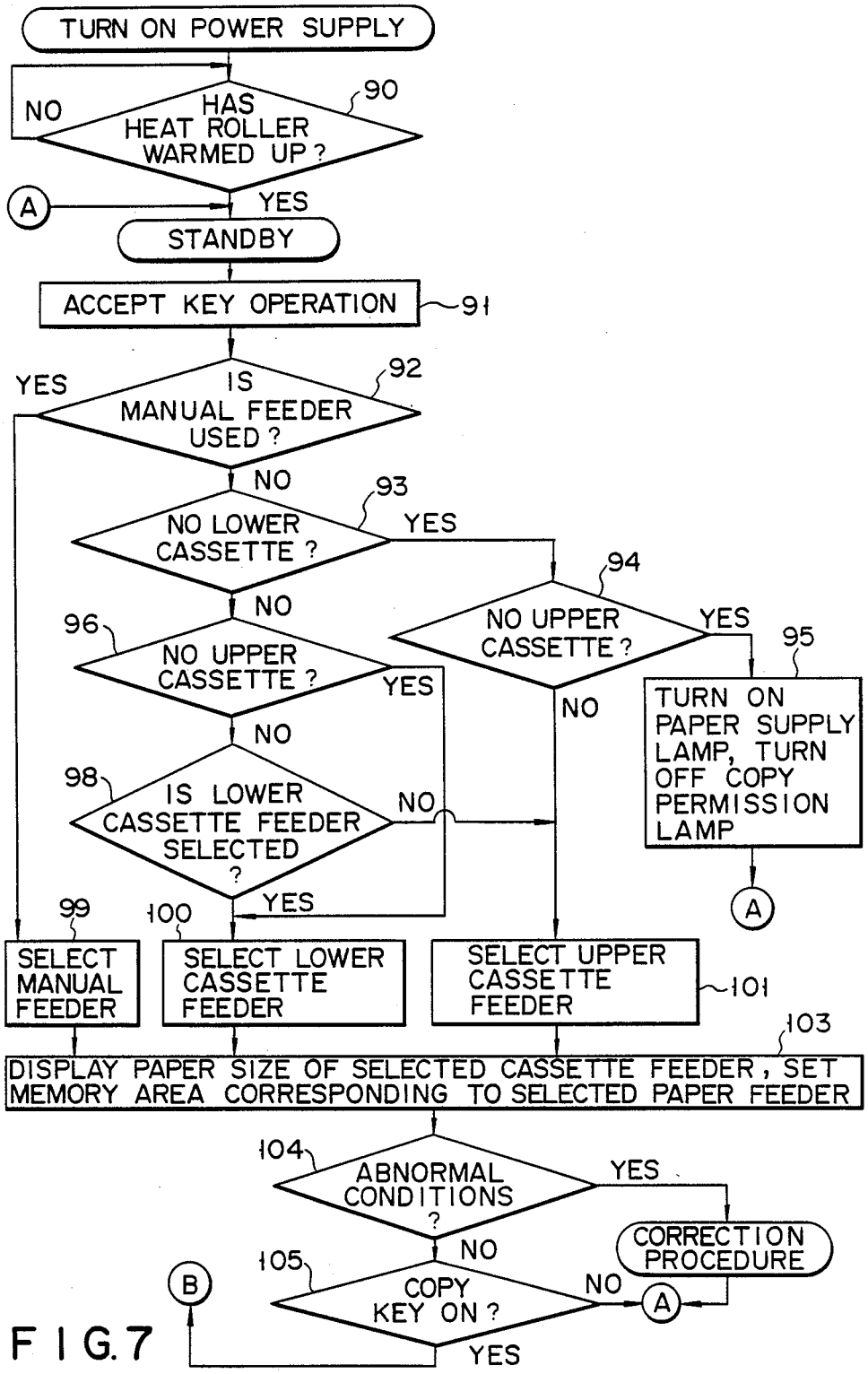
FIG. 7 shows the first half of flowchart representing the operation of the paper supply device of the invention.
Figure 8:
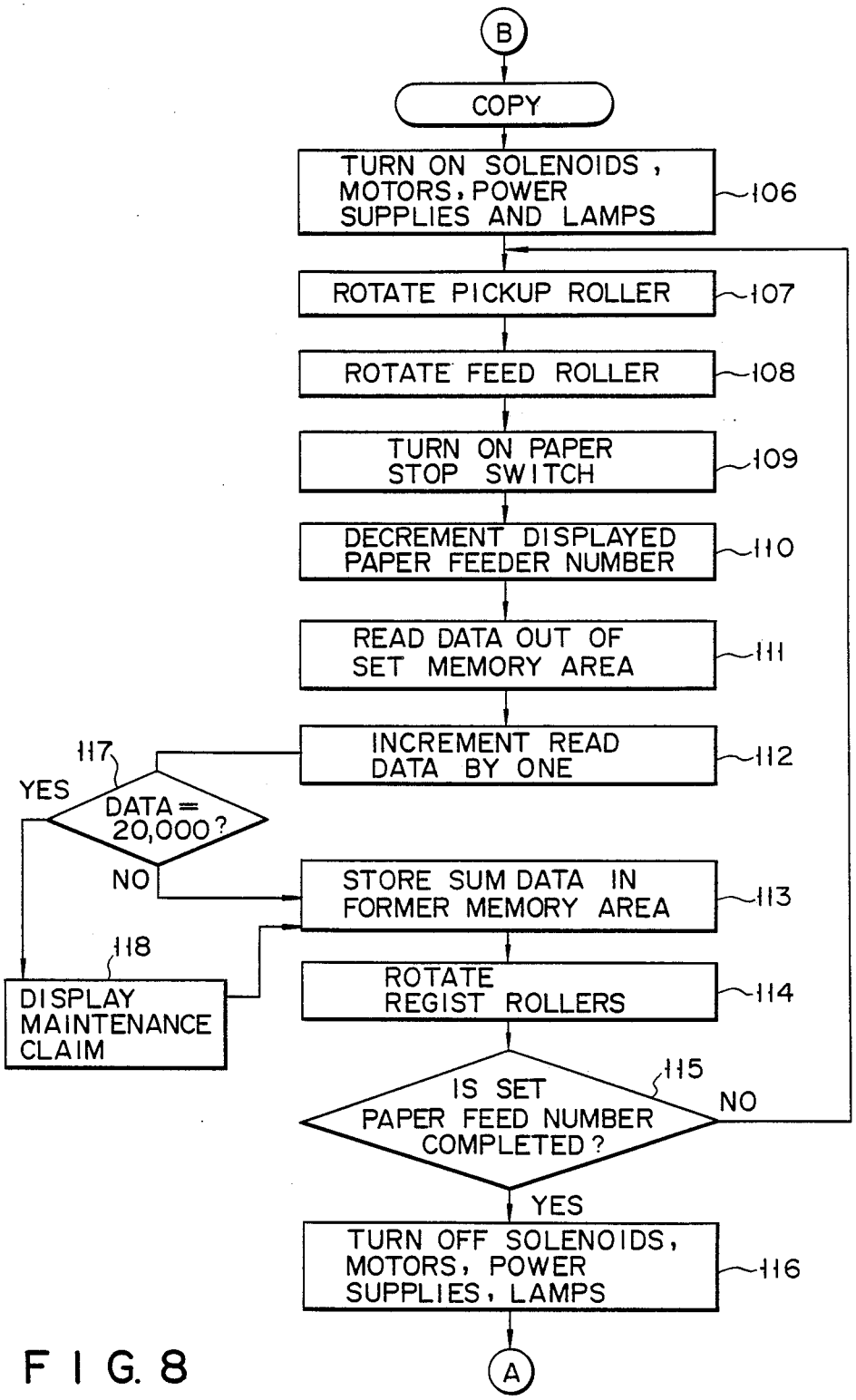
FIG. 8 shows the second half of the flowchart representing the operation of the paper supply device of the invention.

The operation of the paper feed device beginning with the turn-on of the power supply will be described with reference to a flowchart shown in FIGS. 7 and 8. When the power supply is turned on, the operation proceeds to step 90. In step 90 a check is made as to whether heat roller 20 has warmed up or not. If heat roller 20 has been warmed up, then a display lamp for permission of copying on operating panel 87 is lit and the copier enters the standby state. In step 91 a key operation by an operator on control panel 87 is accepted. The operation subsequently proceeds to step 92 in which a check is made as to whether manual feed switch 41 is turned on or not in order to check whether manual feeder 2 is to be used or not. If the switch is not on, then the operation proceeds to step 93. If the switch is on, on the other hand, then the operation proceeds to step 99. In step 99 manual feeder 2 is selected and the operation then proceeds to step 103. In step 93 a check is made as to whether lower cassette 411 is loaded or not by the cassette unloading signal generating means within lower cassette feeder 4. If the lower cassette is not loaded, then the operation proceeds to step 94 in which a check is made as to whether upper cassette 3 is loaded or not. If the upper cassette is not loaded, the paper replenishment lamp on control panel 87 is lit and the copying permission lamp is put out in step 95. The copier is then placed in the standby state. Namely when manual feeder 2 is not used and both of upper and lower cassettes 311 and 411 are not loaded, the supply of transfer paper P is suggested. In step 93, if lower cassette 411 is loaded, the operation proceeds to step 96 in which a check is made as to whether upper cassette 311 is loaded or not. When upper cassette 311 is loaded, the operation proceeds to step 98 in which a check is made as to whether lower cassette feeder 4 is no selected by cassette select key 59 or not. When lower cassette feeder 4 is selected, the operation proceeds to step 100. In step 100 lower cassette 4 is selected and then the operation proceeds to step 103. When upper cassette 311 is not loaded in step 96, step 98 is jumped to step 100. When upper cassette 311 is loaded in step 94 or when lower cassette feeder 4 is not selected in step 98, the operation proceeds to step 101. In step 101 upper cassette feeder 3 is selected and the operation then proceeds to step 103. Namely when upper cassette 311 and/or lower cassette 411 is not loaded, the selection of a cassette feeder or feeders with no cassette loaded is prohibited.

In step 103 memory areas corresponding to the selected cassette feeder are set in memory 81. In other words, corresponding ones of memory areas 81(*a*) through 81(*e*) in memory 81 are selected. Furthermore, in step 103, the size of transfer paper P in the selected cassette feeder is displayed. That is, the identification code of the cassette in the selected cassette feeder is examined to determine the size of the contained transfer paper P and display it on liquid crystal display unit 62 of control panel 87. The operation then proceeds to step 104 to check abnormal operating conditions in body 1 of the copier. If there are any abnormal operating conditions, the procedure for correcting the abnormal condition is carried out and then the copier is placed in the standby state. If there are no abnormal operating conditions, the operation proceeds to step 105 in which a check is made as to whether copy key 50 on control panel 87 is turned on or not. If the key is turned on, then the copy operation is initiated and step 106 is carried out. If the key is off, then the operation returns to the standby state.

In step 106, solenoids, motors, power supplies and lamps are turned on and the operation is then followed by step 107 in which the pickup roller for the selected paper feeder is rotated to initiate the paper feed. Subsequently in step 108 the feed roller is rotated to feed the picked up transfer paper. In step 109, paper stop switch 10 is turned on after the lapse of a predetermined time from the feed of transfer paper P by the feed roller. In step 110, the number of sheets to be copied, displayed by display 56 on control panel 87 (FIG. 4), is decremented by one. In step 111, data is read out of that memory area in memory 81 (FIG. 6) which is selected in step 103 and corresponds to the paper feeder currently in use. In this way CPU 70 is supplied with a signal indicating one paper feed each time paper stop switch 10 is turned on and carries out steps 110 and 111 accordingly. In other words, paper stop switch 10 supplies information about paper feeding to CPU 70. In step 112, the read data is incremented by one and in step 117 a check is made as to whether or not the resultant data corresponds to 20,000, for example. When the resultant data is smaller than 20,000, the resultant data is stored again in the corresponding memory area in step 113. In step 114 regist rollers 11 are rotated to move the transfer paper onto transfer charger 9 for image transfer. In step 115 a check is made as to whether the feed of a previously set number of sheets is completed or not. When completed, the solenoids, motors, power supplies and lamps are turned off in step 116 and the operation returns to the standby state. When not completed in step 115, the operation returns to step 107. When the resultant data is 20,000 in step 118, a claim for maintenance service, including a message such as "call a serviceman", is displayed by liquid crystal display unit 62 in step 118. The operation then proceeds to step 113. The copier is placed in the maintenance wait state during the maintenance claim display and the standby state.

Figure 9:
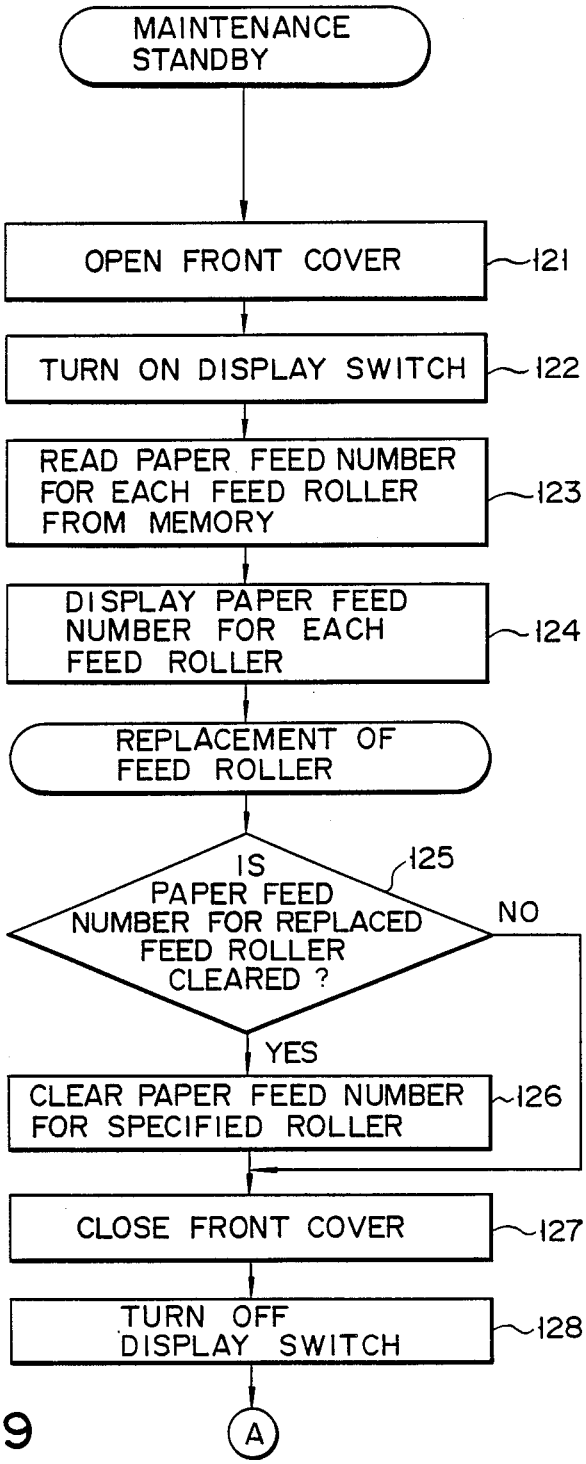
FIG. 9 is a flowchart representing the replacement procedure for feed rollers used in the paper supply device.

Next the readout operation for the number of sheets of paper fed by each feed roller will be described with reference to a flowchart shown in FIG. 9. To read the number of feeds of paper of each feed roller, the operation proceeds from the maintenance wait state to step 121 in which the front cover is opened by the user. In step 122 display switch 63 of liquid crystal display panel 40 is turned on by opening the front cover. In step 123 the contents of the memory areas storing the numbers of paper fed by the respective feed rollers are read out. In step 124 the number of paper fed by each feed roller is displayed on liquid crystal display unit 40 as shown in FIG. 10. The characters and locations for display are stored in the ROM of CPU 70 and read therefrom for setting. After a feed roller or rollers requiring maintaining are replaced, the operation proceeds to step 125. In step 125, a check is made as to whether a request for clearing the number of paper feeds for each feed roller is made or not. The clear request is entered by ten keys 54 on control panel 87 using a code for each feed roller. If the clear request is not made, the operation proceeds to step 127. If the clear request is made in step 125, the operation proceeds to step 126. In step 126 the memory area corresponding to a specified feed roller is cleared. In step 127 the front cover is closed by the user. In step 128 display switch 63 of liquid crystal panel 40 is turned off and the copier returns to the standby state.

With such an arrangement as described above, the count data is stored in the BCD (binary-coded decimal) code and thus data conversion is not needed for display. Since the display switch is turned on only when the front cover is opened for the maintenance of the feed rollers, the display of the count data can be said to be electrically efficient. Moreover, since a signal produced by paper stop switch 10, which is placed in a position where the probability of a jam of transfer paper P is low, is used to sense the number of times of the use of the feed rollers, more accurate count value of paper feeds can be obtained. The reason why the probability of the jam is low is that paper stop switch 10 is placed in the upper portion of the paper feed path and the number of the feed rollers used u to the switch is small.

As described above, according to the present invention, the number of times of the use of each feed roller can accurately be stored and displayed. When the time for the feed rollers to be replaced comes, the display automatically displays that the feed rollers should be replaced. Hence the replacement time for each feed roller of the paper feed device provided with plural paper feeders can be known easily and accurately.

The present invention need not be limited to the embodiment described above. For example, the number of sheets fed by each feed roller may be displayed at regular intervals. Moreover, the present invention may be applied to office automation equipment necessitating medium feed device other than the copier. As counting means hardware may be used instead of software.

What is claimed is:

1. A paper supply device comprising:

first roller means arranged in at least two feed paths for alternative use when a copying operation is performed;

second roller means for sequentially and downstream feeding sheets of copying paper supplied from said first roller means; and detecting means for detecting the frequency of use of said second roller means from the rotational frequency of said second roller means corresponding to a sum of the rotational frequency of said first roller means in the feed paths, rotated by feeding said sheets of copying paper.

2. A paper supply device according to claim 1, further comprising means for providing information indicating that the paper has been fed by said second roller means.

3. A paper supply device according to claim 1, wherein said detecting means includes means for counting the use of said second roller means to provide a count value, and means for storing the count value.

4. A paper supply device according to claim 1, wherein said first roller means includes means for feeding sheets of paper with different sizes in each of said feed paths, and further includes means for displaying the size of the paper to be fed.

5. A paper supply device comprising:

first roller means which are arranged in at least two feed paths for alternative use when a copying operation is performed;

second roller means for sequentially and downstream feeding sheets of copying paper supplied from said first roller means;

detecting means for detecting the frequency of use of said second roller means from the rotational frequency of said second roller means corresponding to a sum of the rotational frequency of said first roller means in the feed paths, rotated by feeding said sheets of copying paper; and means for indicating the results of the detection by said detecting means according to the frequency of the use of said second roller means.

6. A paper supply device according to claim 5, further comprising means for providing information indicating that the paper has been fed by said second roller means.

7. A paper supply device according to claim 5, wherein said detecting means includes means for counting the use of said second roller means to provide a count value, and means for storing the count value.

8. A paper supply device according to claim 5, wherein said indicating means includes means for displaying the frequency of use of said second roller means.

9. A paper supply device according to claim 5, wherein said indicating means includes means for indicating that use of the second roller means has reached a maximum limit.

10. A paper supply device according to claim 5, wherein said detecting means includes means for counting the use of said second roller means to provide a count value, and said indicating means includes means for displaying the count value.

11. A paper supply device according to claim 5, wherein said indicating means including means for providing information indicating that the maintenance of said second roller means is required.

12. A paper supply device comprising:

roller means arranged in at least two feed paths for alternative use when a copying operation is performed;

means arranged in said feed paths, for detecting the size of paper which has been fed; and detecting means arranged in said feed paths, for detecting the frequency of use of said roller means form the rotational frequency of said roller means.

13. A paper supply device according to claim 12, further comprising means for providing information indicating that the paper has been fed by said roller means.

14. A paper supply device according to claim 13, further comprising means for indicating the result of the detection according to the frequency of use of said roller means.

15. A paper supply device according to claim 14, wherein said indicating means includes means for displaying the size of the paper to be fed.

16. A paper supply device comprising:

first and second roller means, each roller means moving paper sheets individually and sequentially;

third roller means for sequentially and individually receiving a paper sheet from either the first or second roller means;

printing means, said printing means positioned to receive paper from the third roller means and print thereupon;

counting means associated with each of the first, second and third roller means to record individually the total amount of rotation of each said roller means;

and means for displaying each total of said measured rotation.

* * * * *